US006748929B2

(12) United States Patent
Przymusinski et al.

(10) Patent No.: US 6,748,929 B2
(45) Date of Patent: Jun. 15, 2004

(54) ELECTRONIC CIRCUIT CONFIGURATION AND CORRESPONDING METHOD FOR CONTROLLING ACTUATORS SUCH AS VALVES OR INJECTORS

(75) Inventors: Achim Przymusinski, Regensburg (DE); Andreas Schiergl, Salching (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/334,465

(22) Filed: Dec. 31, 2002

(65) Prior Publication Data

US 2003/0099079 A1 May 29, 2003

Related U.S. Application Data

(63) Continuation of application No. PCT/DE01/02674, filed on Jul. 17, 2001.

(51) Int. Cl.[7] ..... F02M 51/00

(52) U.S. Cl. ..... 123/490; 123/472; 123/478; 361/152

(58) Field of Search ..... 123/490, 445, 123/472, 478, 480; 361/152

(56) References Cited

U.S. PATENT DOCUMENTS

| | | | | |
|---|---|---|---|---|
| 3,699,397 A | * | 10/1972 | Kuck | 361/152 |
| 4,234,903 A | * | 11/1980 | Harper | 361/154 |
| 4,589,401 A | | 5/1986 | Karim et al. | 123/479 |
| 4,628,885 A | | 12/1986 | Ogburn et al. | 123/490 |
| 4,989,150 A | | 1/1991 | Tazawa | 364/431.03 |
| 5,469,825 A | | 11/1995 | Golab et al. | 123/479 |

FOREIGN PATENT DOCUMENTS

| | | | |
|---|---|---|---|
| DE | 3925881 A1 | 2/1991 | F02D/41/22 |
| DE | 196 05 606 A1 | 8/1997 | G06F/1/24 |
| EP | 0 358 972 A1 | 3/1990 | F02D/41/20 |

OTHER PUBLICATIONS

"Design Techniques for an Intelligent Fuel Injector IC"; A. Marshall, J. Devore and W. Grose; Texas Instruments Inc., Dallas, TX; 1992.

* cited by examiner

*Primary Examiner*—Bibhu Mohanty
(74) *Attorney, Agent, or Firm*—Baker Botts L.L.P.

(57) ABSTRACT

Electronic circuit arrangement for controlling at least one actuator, in particular for controlling the valves and/or the injectors of an injection system of an internal combustion engine, having at least one driver circuit (1, 2) with a control input (control line 1, control line 2) and a resetting input (RESET) for electrically controlling the actuator as a function of the data which is incoming at the control input (control line 1, control line 2), a control unit (3, 4) which is connected at the output end to the resetting input (RESET) via a resetting line and to the control input (control line 1, control line 2) of the driver circuit (1, 2) via a control line, and having a signal input (Kl15) which is connected internally to the control unit (3, 4) for the external connection of a switching element, the control unit (3, 4) placing the driver circuit (1, 2) in a predefined state when the switching element is activated via the resetting line, the signal input for the switching element being connected to the resetting input (RESET) of the driver circuit (1, 2) via a signal path (9) while passing the control unit (3, 4).

10 Claims, 2 Drawing Sheets

Figure 1:
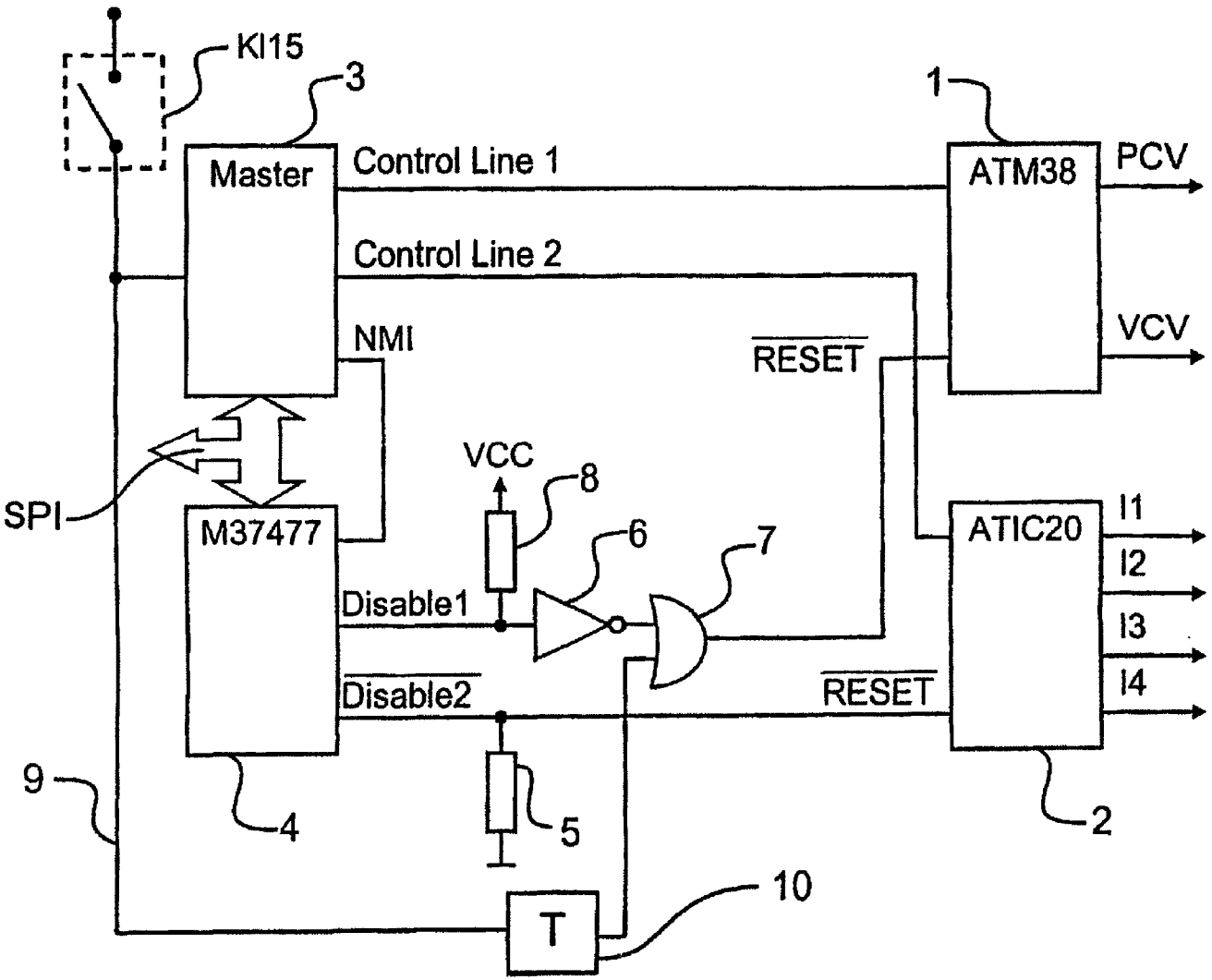

ELECTRONIC CIRCUIT CONFIGURATION AND CORRESPONDING METHOD FOR CONTROLLING ACTUATORS SUCH AS VALVES OR INJECTORS

CROSS-REFERENCE TO RELATED APPLICATIONS

This application is a continuation of International Application No. PCT/DE01/02674 filed Jul. 17, 2001, which designates the United States, which claims priority to German application number DE10036903.0 filed Jul. 28, 2000.

BACKGROUND OF THE INVENTION

The invention relates to an electronic circuit arrangement controlling actuators, in particular for controlling the valves and/or the injectors of an injection system of an internal combustion engine.

Conventional injection systems for internal combustion engines for motor vehicles usually have injectors which inject fuel in each case into a combustion space of the internal combustion engine, the injectors being controlled by means of an electronic driver circuit.

Moreover, conventional injection systems have, in addition to the injectors mentioned above, further controllable actuators, for example volume control valves (VCV) or pressure control valves (PCV) which are also controlled by means of an electronic driver circuit. At the input end, the driver circuits are in turn connected to a microcontroller which predefines the desired operating parameters for the actuators, and predefines, for example, the volume flow rate, the fuel pressure and the injection times.

In addition, known injection systems have a monitoring unit which is connected at the output end to a resetting input of the driver circuit in each case, and which can place driver circuits in a predefined safe state when a malfunction occurs. The monitoring unit is connected here to the microcontroller, for example via a databus, in order to be able to detect a malfunction.

In such injection systems, the driver circuits are to be placed in a safe state in all cases when the driver of the motor vehicle switches off the ignition. The microcontroller is therefore connected at the input end to the ignition switch, and when the ignition is switched off said microcontroller controls the monitoring unit in such a way that the driver circuits arc placed in the safe state.

A disadvantage with the known circuit arrangement described above is the fact that both the microcontroller and the monitoring unit must be functioning satisfactorily in order to place the driver circuits in a safe state. If there is a malfunction of the microcontroller or of the monitoring unit there is thus the risk of the driver no longer being able to place the driver circuits in a safe state by switching off the ignition.

SUMMARY OF THE INVENTION

The invention is thus based on the object of improving the known circuit arrangement described above to the effect that the driver circuits can be reliably placed in a safe state even if there is a malfunction of the microcontroller or of the monitoring unit.

The object can be achieved by an electronic circuit arrangement for controlling at least one actuator comprising at least one driver circuit with a control input and a resetting input for electrically controlling the actuator as a function of the data which is incoming at the control input, a control unit which is connected at the output end to the resetting input via a resetting line and to the control input of the driver circuit via a control line, and comprising a signal input which is connected internally to the control unit for the external connection of a switching element, the control unit placing the driver circuit in a predefined state when the switching element is activated via the resetting line, wherein the signal input for the switching element is coupled with the resetting input of the driver circuit via a signal path while bypassing the control unit.

A method for checking the resetting of a driver circuit by a control unit in a circuit arrangement, may comprise according to the present invention the following steps:

- a resetting input of the driver circuit is activated by means of the control unit via a resetting line,
- the behavior of a device which is influenced by an actuator is detected after the activation of the resetting input of the driver circuit,
- the behavior of the device which is influenced by the actuator is evaluated in order to check satisfactory resetting of the driver circuit.

The invention comprises the general technical teaching of providing, in addition to the actuation of the resetting input of the driver circuits by the microcontroller or the monitoring unit while bypassing the microcontroller and the monitoring unit, a signal path from the ignition switch to the resetting input of the driver circuits so that the switching off of the driver circuits functions reliably even when there is a malfunction of the microcontroller or of the monitoring unit.

A logic circuit is preferably arranged upstream of the resetting input of the driver circuits and is connected at the input end, on the one hand, to the control unit which is preferably composed of a microcontroller and a monitoring unit, and, on the other hand, to the signal input while bypassing the control unit, for the connection of the ignition switch, the resetting input of the driver circuit being activated if a corresponding activation signal is present at an input of the logic circuit. The resetting of the driver circuit into the safe states therefore take place in this variant of the invention optionally by means of the control unit or directly by means of the ignition switch.

The resetting input of the driver circuit is preferably high active so that the driver circuit is placed in a safe state if a high level is present at the resetting input of the driver circuit. In this case, the logic circuit which is arranged upstream of the resetting input of the driver circuit preferably has an OR gate.

In another variant of the invention, the resetting input of the driver circuit is, on the other hand, low active, so that the driver circuit is placed in a safe state if a low level is present at the resetting input of the driver circuit. In this case, the logic circuit which is connected upstream of the resetting input of the driver circuit preferably has an AND gate.

In one advantageous variant of the invention, a delay element is arranged in the signal path bypassing the control unit, between the signal input for the switching element (for example the ignition switch), which brings about the switching off of the driver circuit, and the resetting input of the driver circuit, the delay of the delay element being preferably longer than the processing time necessary to reset the driver circuits by means of the control unit. This provides the advantage that in the normal operating mode when the control unit is functioning satisfactorily the driver circuits are always reset by means of the control unit and not via the signal path which bypasses the control unit. The delay of the delay element is therefore preferably more than 700 ms, which is generally sufficient.

The control unit for controlling the driver circuits is preferably composed of a microcontroller and a monitoring unit which is connected to the microcontroller, the microcontroller being connected at the output end to the control input of the driver circuit via a control line, whereas the monitoring unit is connected at the output end to the driver circuit via a resetting line. The microcontroller therefore predefines the data (for example fuel pressure, volume flow rate, injection period) with which the driver circuits controls the actuators (for example volume control valve, pressure control valve, injectors), whereas the monitoring unit monitors the operation of the microcontroller and places the driver circuits in a safe state when a malfunction occurs.

In this variant of the invention, the microcontroller and the monitoring unit are preferably connected to one another via a databus, the databus preferably being an SPI (serial peripheral interface) bus.

The variant of the invention described above with a delay element in the signal path which bypasses the control unit provides the advantage that the operational capability of the switching off of the driver circuits by the control unit can be checked in the normal operating mode. In such a monitoring method according to the invention, it is firstly determined whether the ignition switch has been opened, as switching off then takes place in any case after the predefined delay time has expired. The control unit then activates the resetting line for a driver circuit, whereas the resetting lines of the other driver circuit remain uninfluenced. However, when it is functioning satisfactorily the internal combustion engine must nevertheless react with a drop in rotational speed within the delay time as, for example, the volume control valve has been closed. Sensing a corresponding drop in the rotational speed despite the switching off of only a single driver circuit therefore indicates that the associated resetting line is operating satisfactorily.

BREIF DESCRIPTION OF THE DRAWINGS

Figure 2:
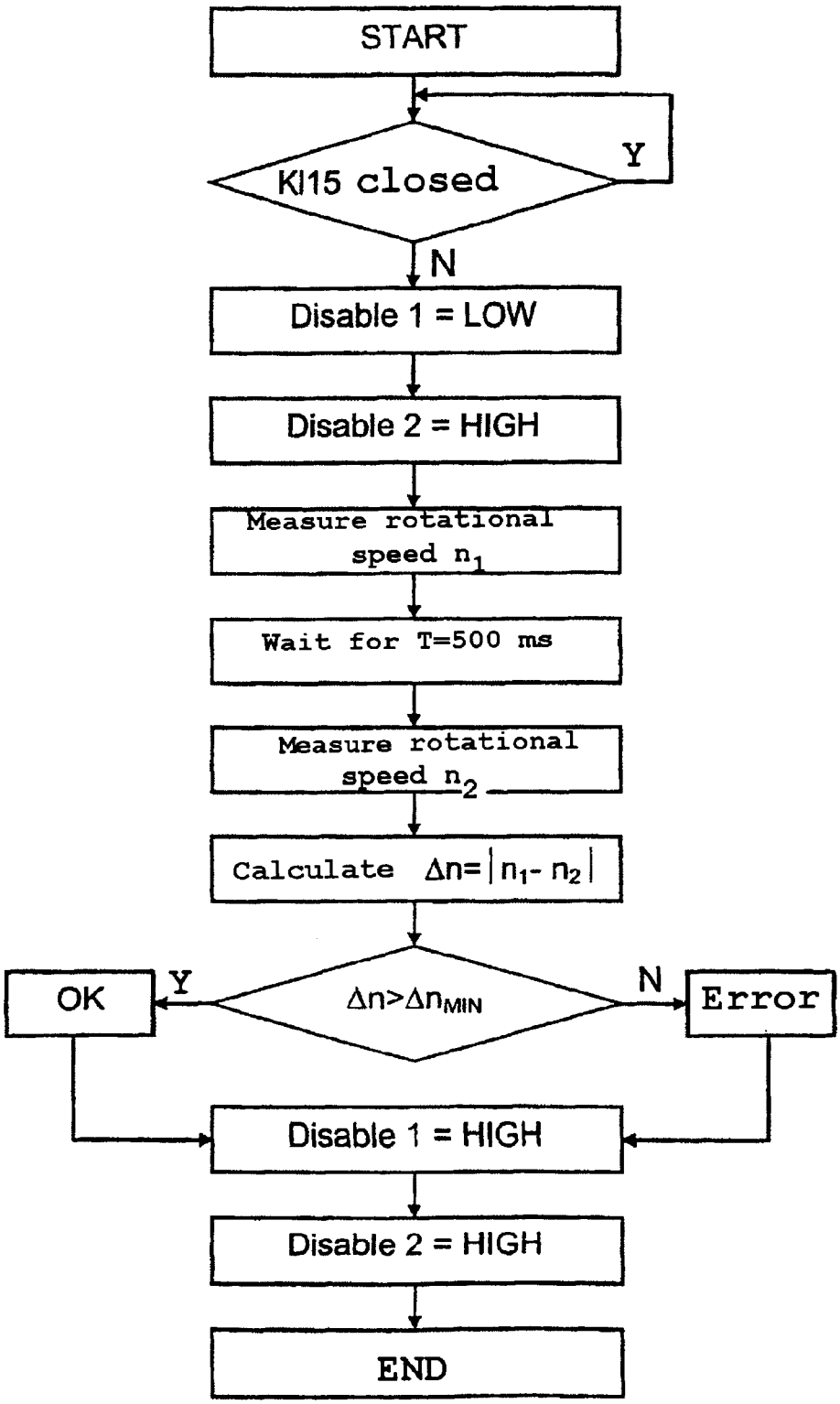

Other advantageous variants of the invention are described in the subclaims and explained below together with the description of the preferred exemplary embodiment of the invention, with reference to the figures, of which:

FIG. 1 shows the preferred exemplary embodiment of the circuit arrangement according to the invention as a block circuit diagram, and FIG. 2 shows a method for checking the resetting of the driver circuit by the control unit.

DETAILED DESCRIPTION OF THE PREFERRED EMBODIMENTS

The electronic circuit arrangement illustrated in FIG. 1 serves to controls the actuators of an injection system for an internal combustion engine.

For this purpose, the circuit arrangement has a driver circuit 1 which controls at the output end, on the one hand, a pressure control valve (PCV) and, on the other hand, a volume control valve (VCV), both the volume control valve and the pressure control valve being omitted from the illustration for the sake of simplification. Furthermore, the circuit arrangement according to the invention has a driver circuit 2 which controls four injectors I1–I4 of the injection system, and thus defines the injection time and the injection period.

These parameters are predefined both for the driver circuit 1 and for the driver circuit 2 by means of a master microcontroller 3 which is connected at the output end to the driver circuit 1 or to the driver circuit 2 via two control lines control line 1, control line 2, and predefines the operating parameters such as fuel pressure, volume flow rate, injection time and injection period.

At the input end, the master microcontroller 3 is connected to an ignition switch KL15 so that the injection process is interrupted during the switching off of the ignition and during the associated opening of the ignition switch KL15. During the switching off of the ignition switch K115, the master microcontroller 3 detects this in the normal operating mode and deactivates the control lines control line 1 and control line 2. This leads to the switching off of the injection. Furthermore, the master microcontroller 3 has the possibility of informing a monitoring unit 4, via an interrupt line NMI (nonmaskable interrupt) that two resetting lines DISABLE1 and DISABLE2 are to be activated. In the process, the driver circuits 1, 2 are placed in a safe state in which no fuel is injected.

The driver circuits 1, 2 are therefore controlled into the safe state not only by the master microcontroller 3 but also by the monitoring unit 4 of the M37477 type, which is connected to the master microcontroller 3, on the one hand via a databus SPI (serial peripheral interface), and on the other hand via the interrupt line NMI (nonmaskable interrupt). The interrupt line NMI makes it possible to signal to the master microcontroller 3, the monitoring unit 4, that the injection operation has to be interrupted. Moreover, the injection process is interrupted even if the monitoring unit 4 detects, by reference to the data transmitted via the databus SPI, that a malfunction of the master microcontroller 3 is present.

In both cases, the monitoring unit 4 transmits a resetting signal to the corresponding resetting input RESET of the driver circuit 2 via the resetting line DISABLE2, so that said driver circuit 2 is placed in a safe state in which no fuel is injected since all the injectors I1–I4 close. The resetting line DISABLE2 between the monitoring unit 4 and the driver circuit 2 is connected to ground via a pull-down resistor 5 so that the resetting line DISABLE assumes a low level when there is an initializing process of the monitoring unit 4 and a resulting high-impedance state at the output of the monitoring unit 4.

Furthermore, in both cases described above, the monitoring unit 4 outputs, via the resetting line DISABLE1, a resetting signal which is fed to the low-active resetting input of the driver circuit 1 via an inverter 6 and an AND gate 7. In order to reset the driver circuit 1, the monitoring unit 4 therefore outputs a high level via the resetting line DISABLE1 so that a low level appears at the output of the inverter 6, which leads to a low level at the output of the AND gate 7, irrespective of the signal level at the other input of the AND gate 7, and thus to resetting of the driver circuit 1. The resetting line DISABLE1 is connected to a supply voltage VCC between the monitoring unit 4 and the inverter 6 via a pull-up resistor 8, in order to generate a defined high level on the resetting line DISABLE1 when there is an initialization process of the monitoring unit 4 and a resulting high-impedance state at the output of the monitoring unit 4.

Furthermore, the illustrated circuit arrangement according to the invention also permits the driver circuits 1, 2 to be acted on directly from the ignition switch KL15. The ignition switch KL15 is therefore connected to a delay element 10 via a signal path 9 which bypasses both the master microcontroller 3 and the monitoring unit 4, said delay element 10 passing on the signal present at its input to the second input of the AND gate 7 with a delay of Tv=800 ms. Alternatively, other delay times Tv≧700 ms can also be used. When the ignition switch KL15 is opened, a low level, which is passed onto the AND gate 7, and thus also to the resetting input of the driver circuit 1, after the expiry of the predefined delay time, therefore appears immediately at the input of the delay element 10. Even when there is complete malfunction of the master microcontroller 3 or of the monitoring unit 4, opening of the ignition switch KL15 therefore causes the driver circuits 1, 2 to be reset to a safe state.

Furthermore, the circuit arrangement according to the invention which is illustrated in FIG. 1 permits the satisfactory resetting of the driver circuit 1 and 2 to be checked by the monitoring unit 4 without the normal operation having to be interrupted, as is apparent from the flowchart illustrated in FIG. 2. The satisfactory resetting is in fact not checked until the ignition switch KL15 is opened. For this reason, the system firstly waits in the first step until the ignition switch KL15 is opened. The monitoring unit 4 then sets the reset signal DISABLE1 to low and the reset signal DISABLE2 to high, which, when the circuit arrangement is functioning correctly, leads to resetting of the driver circuit 2, but not to resetting of the driver circuit 1.

The rotational speed n1 of the internal combustion engine is measured immediately afterwards and the system waits for a time period of T=500 ms. After this waiting time has expired, the rotational speed n2 of the internal combustion engine is measured again in order to detect the response of the internal combustion engine to the resetting of the driver circuit 2. It is to be noted here that resetting of the driver circuit 2 leads to closing of the injectors I1–I4 so that fuel is no longer injected. The reduction in the rotational speed is then calculated and compared with a predefined limiting value. Given satisfactory resetting of the driver circuit 2, the reduction $\Delta n$ in the rotational speed must exceed the predefined minimum limiting value $\Delta n_{min}$. Otherwise, an error is present. After the checking of the correct response of the internal combustion engine which has been described above and the correct switching of the driver circuit 2 which is to be derived therefrom, the two resetting signals DISABLE1 and DISABLE2 are set to high since both driver circuits 1, 2 are to be switched off. The checking method described above therefore takes place in the coasting after the opening of the ignition switch KL15 and does not adversely affect the normal operating mode of the internal combustion engine or of the injection system.

In the same way, the correct switching off of the driver circuit 1 can of course also be checked instead of the correct switching off of the driver circuit 2. To do this, all that is necessary is to use, instead of the abovementioned low and high levels on the resetting lines DISABLE1 and DISABLE2, signal levels which are correspondingly inverted at the start of the checking method.

The invention is not restricted to the exemplary embodiments described above. Instead, a multiplicity of variants and refinements which make use of the technical teaching according to the invention, and therefore also fall within the sphere of protection, are conceivable.

What is claimed is:

1. An electronic circuit arrangement for controlling at least one actuator comprising at least one driver circuit with a control input and a resetting input for electrically controlling the actuator as a function of the data which is incoming at the control input, a control unit which is connected at the output end to the resetting input via a resetting line and to the control input of the driver circuit via a control line, and comprising a signal input which is connected internally to the control unit for the external connection of a switching element, the control unit placing the driver circuit in a predefined state when the switching element is activated via the resetting line, wherein the signal input for the switching element is coupled with the resetting input of the driver circuit via a signal path while bypassing the control unit.

2. The circuit arrangement as claimed in claim 1, wherein a logic circuit is connected upstream of the resetting input of the driver circuit and is connected at the input end, on the one hand, to the control unit and, on the other hand, to the signal input via the signal path, the resetting input of the driver circuit being able to be optionally activated by means of the control unit and/or the signal input.

3. The circuit arrangement as claimed in claim 2, wherein the resetting input of the driver circuit is HIGH active and the logic circuit has an OR gate.

4. The circuit arrangement as claimed in claim 2, wherein the resetting input of the driver circuit is LOW active and the logic circuit has an AND gate.

5. The circuit arrangement as claimed in claim 1, wherein a delay element is arranged in the signal path bypassing the control unit, between the signal input for the switching element and the resetting input of the driver circuit.

6. The circuit arrangement as claimed in claim 5, wherein the delay element has a delay of more than 700 ms.

7. The circuit arrangement as claimed in claim 1, wherein the control unit comprises a microcontroller and a monitoring unit which is connected to the microcontroller, the microcontroller being connected at the output end to the control input of the driver circuit via the control line, whereas the monitoring unit is connected at the output end to the driver circuit via the resetting line.

8. The circuit arrangement as claimed in claim 7, wherein the microcontroller and the monitoring unit are connected to a databus.

9. The circuit arrangement as claimed in claim 8, wherein the databus is an SPI bus.

10. The circuit arrangement as claimed in claim 1, wherein the circuit controls the valves and/or the injectors of an injection system of an internal combustion engine.

* * * * *

UNITED STATES PATENT AND TRADEMARK OFFICE

CERTIFICATE OF CORRECTION

PATENT NO. : 6,748,929 B2
DATED : June 15, 2004
INVENTOR(S) : Przymusinski et al.

It is certified that error appears in the above-identified patent and that said Letters Patent is hereby corrected as shown below:

Title page,
After Item [65], please insert the following item:

-- [30] Foreign Application Priority Data
July 28, 2000 (DE)……..100 36 903 --

Signed and Sealed this

Thirty-first Day of August, 2004

JON W. DUDAS
*Director of the United States Patent and Trademark Office*